United States Patent [19]

Cadars

[11] Patent Number: 4,457,362

[45] Date of Patent: Jul. 3, 1984

[54] WATER BOX AND EXPANSION CHAMBER ASSEMBLY

[75] Inventor: Patrick Cadars, Montigny le Bretonneux, France

[73] Assignee: Valeo, Paris, France

[21] Appl. No.: 356,431

[22] Filed: Mar. 9, 1982

[30] Foreign Application Priority Data

Apr. 2, 1981 [FR] France ..... 81 06674

[51] Int. Cl.[3] ..... F28D 13/00

[52] U.S. Cl. ..... 165/104.32; 165/11 R; 165/35; 165/71

[58] Field of Search ..... 165/148, 149, 150, 35, 165/104.32, 11 R, 71

[56] References Cited

U.S. PATENT DOCUMENTS

| | | | |
|---|---|---|---|
| 2,023,920 | 12/1935 | Eisinger et al. | 165/35 |
| 3,455,377 | 7/1969 | Hayes | 165/148 |
| 3,989,103 | 11/1976 | Cieszko et al. | 165/150 |
| 4,098,328 | 7/1978 | Cheong | 165/148 |
| 4,289,507 | 9/1981 | Cadars et al. | 165/148 |

FOREIGN PATENT DOCUMENTS

| | | | |
|---|---|---|---|
| 379991 | 11/1907 | France | 165/49 |
| 1332683 | 6/1963 | France . | |
| 2083745 | 12/1971 | France . | |
| 2159863 | 6/1973 | France . | |
| 2278914 | 2/1976 | France . | |
| 2458379 | 1/1981 | France . | |
| 2466002 | 3/1981 | France . | |

*Primary Examiner*—Stephen F. Husar

*Attorney, Agent, or Firm*—Dennison, Meserole, Pollack & Scheiner

[57] ABSTRACT

In a heat exchanger, e.g. a radiator for a motor vehicle, the water box (10) and the expansion chamber (11) are made in a single plastic moulding, and are divided by a common wall (12) having at least one orifice for liquid communication therebetween. The expansion chamber tapers from a wider bottom to a narrower top. The narrower top has a filler cap, while the wider bottom is closed by an add-on cover.

13 Claims, 4 Drawing Figures

WATER BOX AND EXPANSION CHAMBER ASSEMBLY

The present invention relates to a water box and expansion chamber assembly for a heat exchanger such as the radiator in the cooling circuit of a motor vehicle. The water box and the expansion chamber are obtained by moulding and they share a common wall which separates one from the other, and which includes a communication orifice, and optionally a degassing orifice.

BACKGROUND OF THE INVENTION

Such an assembly is known in which the water box and the expansion chamber are disposed generally vertically with the upper part of the expansion chamber being provided with a liquid filler orifice suitable for receiving a stopper that includes a set of over pressure and under pressure release valves. The cross section of the expansion chamber tapers going down from the top in order to facilitate with drawing a molding core, andd the said communication orifice is at or near the bottom of the expansion chamber.

This known arrangement suffers from various drawbacks. Firstly, the stopper for closing the top of the expansion chamber must either have at least the same area as the largest cross section of the expansion chamber, which means that outsize stoppers have to be used with expansion chambers of ordinary size, or else some kind of funnel shaped cover must be fitted to the top of the expansion chamber, or else the expansion chamber must be re-designed to be of smaller cross section than usual in order to receive a normally sized stopper. Secondly, it is inconvenient for the small end of the expansion chamber's taper to be the end near to its communication orifice with the water box, since under these circumstances, a shortage of water in the radiator then causes the water level to drop more quickly in said end of the expansion chamber, and it may drop right down to the said communication orifice.

Further, the relatively small cross section at the bottom end of the expansion chamber causes liquid to circulate more quickly in this zone, which leads to there being an increased danger of air bubbles going into the radiator via the communication orifice, and hence to poorly de-gassed liquid circulating therein.

Preferred embodiments of the present invention reduce these drawbacks.

SUMMARY OF THE INVENTION

The present invention provides a water box and expansion chamber assembly for a heat exchanger including at least one heat conveying liquid, e.g. the radiator of a motor vehicle, wherein the water box and the expansion chamber are made by moulding with a common dividing wall having an orifice for liquid communication between the expansion chamber and the water box, the cross section of the expansion chamber increasing gradually from one end thereof to the other, the smaller end of the expansion chamber being terminated by a filler orifice, and the larger end of the expansion chamber being closed by an add-on cover.

Thus, the invention makes it possible for the cross section of the expansion chamber to be independent from the area of its filler orifice, which means that the expansion chamber can be closed using a stopper of standard size, and that the filler orifice may be disposed in any convenient manner relative to the axis of the expansion chamber.

At the same time, since the expansion chamber tapers from a relatively large bottom to a relatively small top, a shortage of water in the heat exchange circuit leads to a relatively slow drop of liquid level in the lower part of the expansion chamber, so the liquid flows more slowly, so there is less risk off air bubbles being entrained into the radiator, and hence de-gassing is improved.

The add-on cover may be designed to perform various extra functions, e.g. it may have a fixing peg or finger on its outside surface; it may be shaped to receive a liquid level detector to indicate when the expansion chamber is short of liquid; it may include bleeder means; or it may include a stopper with valves for setting a safe pressure level inside the expansion chamber.

BRIEF DESCRIPTION OF THE DRAWINGS

Embodiments of the invention are described by way of example with reference to the accompanying drawings, in which.

MORE DETAILED DESCRIPTION

Figure 1:
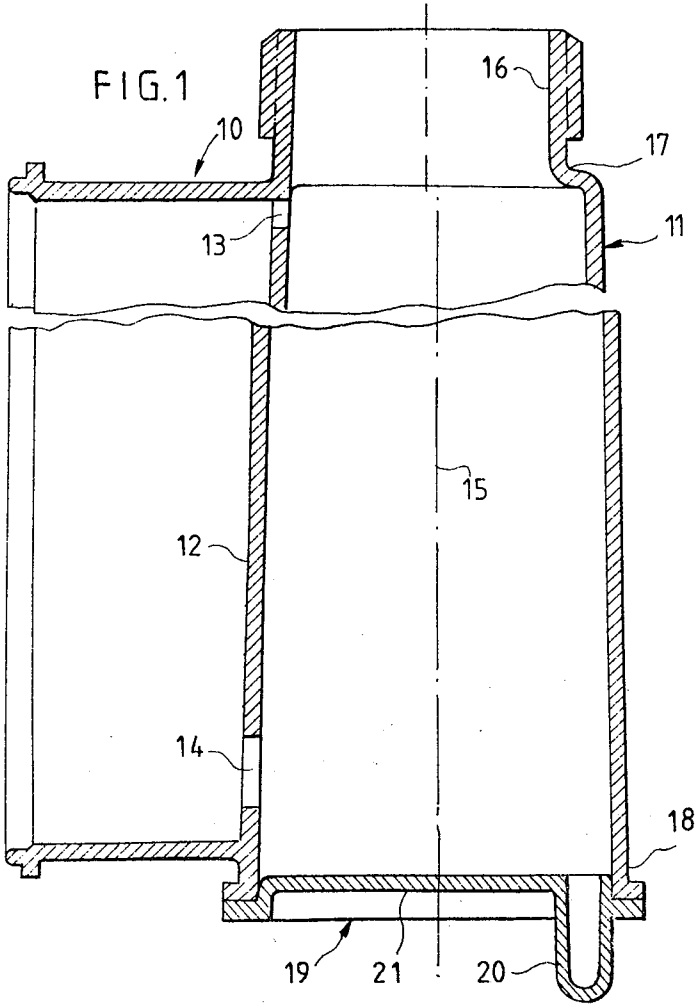
FIG. 1 is a partial diagrammatic vertical section through a water box and expansion chamber assembly in accordance with the invention.

The water box and expansion chamber assembly shown in FIG. 1 is moulded in a single piece of plastic. The expansion chamber 11 is tubular and of substantially circular cross section, and the water box 10 is separated therefrom by a wall 12 having a degassing orifice 13 near its top and an orifice 14 near its bottom for communication between the water box 10 and the expansion chamber 11.

In this embodiment the assembly is intended for generally vertical disposition, i.e. the longitudinal axis 15 of the expansion chamber 11 is substantially vertical. However, the assembly could be designed for horizontal use.

The top 16 of the expansion chamber 11 constitutes a filler orifice, and its ouside surface is threaded to receive a conventional stopper of the kind that is generally provided with a set of under pressure and over pressure release valves. The filler orifice projects above the top of the water box 10 and may be mounted off the axis 15 (as shown), with a joggle 17 bridging the gap. The expansion chamber is gently flared from a relatively smaller top 16 to a larger bottom 18 which is closed and sealed by a cover 19 fixed thereto in any suitable manner. The increasing cross section of the expansion chamber 11 makes it easy to mould the assembly in plastic, using a tapering mould core that is removed after the plastic has set via said end 18.

As indicated above, having a wider bottom to an expansion chamber favours the retention of a minimal quantity of liquid in the expansion chamber, and improves degassing, i.e. the separation of bubbles of air from the water in the expansion chamber, by reducing a rate at which liquid flows in the lower part of the expansion chamber and by avoiding air bubbles being sucked through the orifice 14 into the radiator.

In the embodiment shown in FIG. 1, the cover 19 which closes the bottom 18 of the expansion chamber 11 includes a fixing peg or finger 20 projecting from the outside face 21 of the cover 19.

Figure 2:
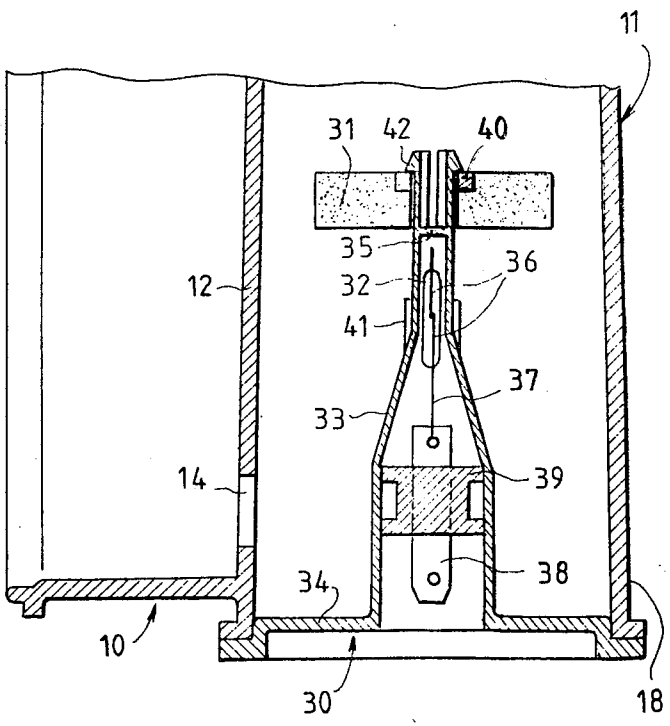
FIG. 2 is a view similar to the bottom half of FIG. 1, showing a second embodiment.

In the embodiment shown in FIG. 2, the cover 30 which closes the bottom 18 of the expansion chamber 11 serves as a support for a detector to detect when there is too little liquid in the expansion chamber. The detector comprises a float 31 and a magnetically controlled electric switch 32 such as a reed switch capsule.

The reed switch bulb 32 is lodged in tubular sleeve 33 which is closed at 35 not far from its top end, and which projects up into the expansion chamber 11 in a funnel-like manner from the cover 30. The spring blades 36 inside the bulb 32 are connected by conductors 37 to contact blades 38 mounted on a part 39 which is lodged in the tubular sleeve 33.

The float 31 carries a permanent magnet 40, and is annular in shape, being threaded over the top of the sleeve 33, in such a manner as to be vertically slidable therealong. Its movement is limited by lower stops 41 and upper stops 42 which form a rim at the top of the sleeve 33. The top of the sleeve is split so that the float ring can be snap fitted on the sleeve 33.

So long as the expansion chamber is filled with liquid to a normal depth, the float is held against the upper stops 42, but when the level drops sufficiently, the ring float 31 will drop until its magnet 40 changes the state of the contacts in the reed switch capsule 32, thereby generating an alarm signal. Clearly the contacts could be either normally closed or normally open; all that matters is that they should change to another condition when the level of liquid is abnormal.

Figure 3:
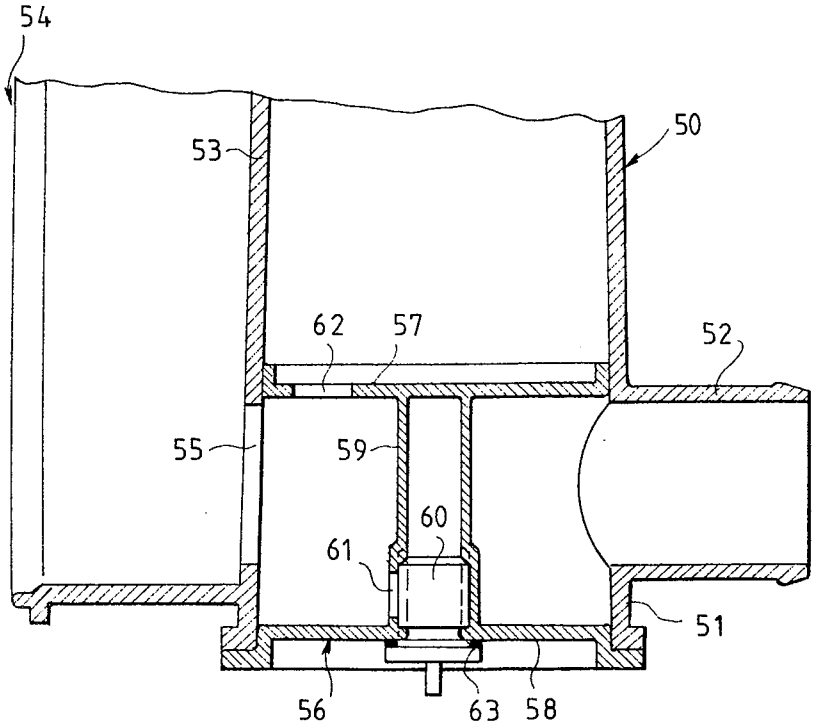
FIG. 3 is a view similar to FIG. 2, showing a third embodiment.

In the embodiment shown in FIG. 3, the bottom 51 of the expansion chamber 50 includes a heat exchanger outlet tube 52, and the wall 53 separating the expansion chamber from the water box 54 includes a communication orifice 55 opposite the end of the outlet tube 52.

The cover 56 closing the bottom 51 of the expansion chamber 50 comprises an upper disk 57 and a lower disk 58 which are interconnected by a vertical axial tube 59. The top of the tube 59 is closed by the upper disk 57, while the bottom of the tube 59 opens out through the lower disk 58. A cylindrical plug 60 is screwed into the bottom of the tube 59 to close both the bottom of the tube 59 and a side opening 61 located in the tube wall near to its bottom. The upper disk has an orifice 62 passing therethrough which is smaller than the bore of the outlet pipe 52 or the orifice 55 passing through the dividing wall 53.

In normal operation, the orifice 61 is closed by the stopper 60 which also seals the bottom of the tube 59 by means of a sealing ring 63. Liquid leaving the water box 54 passes through the orifice 55, flows round the tube 59, and passes on to the outlet tube 52. The orifice 62 in the upper disk 57 of the cover 56 allows the expansion chamber to operate normally.

To empty the heat exchanger, all that needs to be done is to unscrew the stopper 60, and the liquid contained in the heat exchanger then flows into the tube 59 via the orifice 61 and on out of the system via the bottom of the tube.

Figure 4:
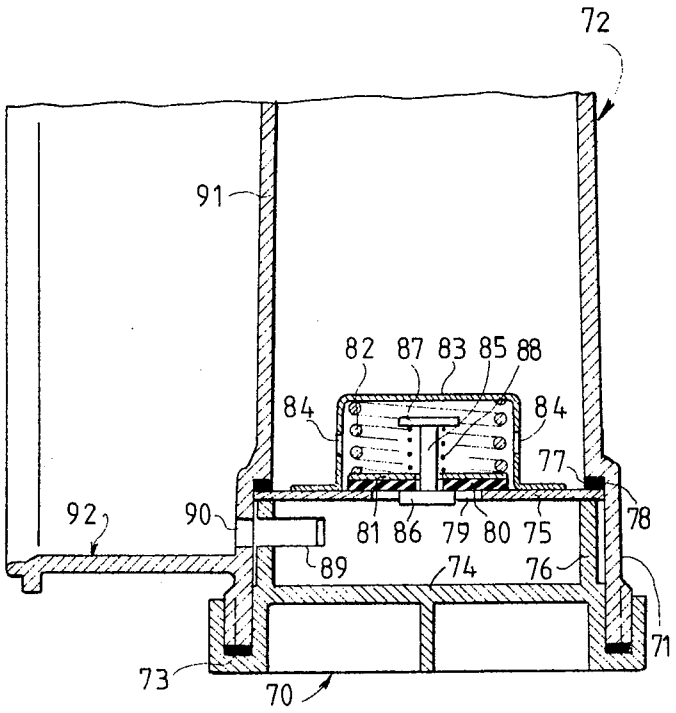
FIG. 4 is a view similar to FIGS. 2 and 3, showing a fourth embodiment.

In the embodiment shown in FIG. 4, the cover 70 which closes the bottom 71 of the expansion chamber 72 is screwed to the bottom and seals it by means of a sealing ring 73. The cover 70 is generally cylindrical, being of circular cross section and comprising a lower disk 74 and an upper disk 75 interconnected by a tubular skirt 76. The upper disk 75 presses against an internal shoulder 77 in the expansion chamber 72 via a sealing ring 78.

The upper disk 75 is provided with a central orifice 79 which is closed by a flexible valve disk 80 made of rubber or the like and resting on the upper surface of the upper disk 75. The upper surface of the flexible valve disk 80 is reinforced by a metal disk 81, and a spring 82 presses down thereon from a bridge member 83 which is firmly attached to the upper disk 75.

In the figure, the bridge member 83 is in the form of an upsidedown cylindrical bowl with a rim made fast to the upper disk 75 and with holes 84 for liquid to flow through. Any other form of bridge that provides a fixed point to which to secure the spring 82 and also allows liquid to flow into the expansion chamber from the orifice 80 would also be suitable.

There is a hole through the center of the valve disk 80 and its reinforcing metal 81, and the hole is closed by a valve disk 86 which is resiliently urged upwards against the lower surface of the valve disk 80 by means of a rod 85 passing through the central hole and a spring 88 acting between the other end 87 of the rod 85 and the upper surface of the reinforcing disk 81.

The skirt 76 of the cover 70 has a circumferentially extending slot 89 substantially opposite an orifice 90 in the wall 91 dividing the expansion chamber 72 and the water box 92 in the assembly.

The set of over pressure and under pressure valves which has just been described works as follows:

If the pressure in the expansion chamber 72 is higher than the pressure in the water box 92, the resulting downwards force on the valve disks will tend to move the valve disk 86 downwards. Once the force applied to the valve disk 86 by the pressure difference exceeds the force applied thereto by the spring 88, the valve disk 86 will move downwards, opening the central hole in the valve disk 80, thereby establishing communication from the expansion chamber into the water box.

In the contrary case, the resultant force on the valve disks is upwards, and once said force overcomes the force of the spring 82 the valve disk 80 will lift off the upper cover disk 75 and liquid will flow from the water box into the expansion chamber via the orifice 79 and the orifices 84.

Naturally, in this embodiment, the expansion chamber 72 does not include a degassing orifice through the top of the dividing wall 91, and its top end is not closed by a stopper having over pressure and under pressure release valves, but by a simple stopper having a vent to provide communication with the ambient air.

I claim:

1. A combination water box and expansion chamber for a heat exchanger including a unitary plastic body divided into at least two portions separated by a common wall, the first portion constituting a water box and including means defining an opening in said common wall in communication with the second portion constituting an expansion chamber, said expansion chamber having a generally tapered cross section throughout its length and terminating at its smaller end in a filler neck configured to receive a removable closure member, said expansion chamber further including an opening at its opposite end equal in size to the maximum internal size of the chamber and closed by a cover plate positioned over said opening.

2. An assembly according to claim 1, wherein the cover plate includes a locating peg or finger projecting from its outside face.

3. An assembly according to claim 1, wherein the cover plate includes a sleeve extending into the expansion chamber, and suitable for receiving means for detecting a shortage of liquid in said expansion chamber.

4. An assembly according to claim 3, wherein said sleeve contains a magnetically operated electrical switch located inside the expansion chamber, and is surrounded by a magnet carrying float that is free to slide along the sleeve, in such a manner that when the level of liquid inside the expansion chamber drops below a threshold depth, the float moves from a normal position to a lower position, and in so doing, causes the magnetically operated switch to change state from a normal state to an abnormal state.

5. An assembly according to claim 1, wherein the cover plate includes means for draining the heat exchanger.

6. An assembly according to claim 5, wherein the draining means comprises means for putting the expansion chamber and the water box into communication with each other, and means for putting the water box into communication with a drain outlet from the heat exchanger.

7. An assembly according to claim 5 or 6, wherein the drain means comprises inner and outer disks interconnected by a central tube which includes an orifice in its side wall communicating with the water box, the outer disk closing the top of the tube and having an orifice providing communication between the water box and the expansion chamber, and the inner disk having a tapped orifice leading into the bottom of the tube, said tapped orifice having a sealing stopper screwed therein.

8. An assembly according to claim 1, wherein the cover plate includes rated under pressure and over pressure release valves to provide communication between the water box and the expansion chamber whenever there is an excessive pressure difference between them.

9. An assembly according to claim 8, wherein the cover plate is in the form of a tube with closed ends, its peripheral wall having an orifice communicating with the water box and its upper end surface having an orifice communicating with the expansion chamber, said orifice in the upper end surface being closed by a set of over pressure and under pressure release valves.

10. An assembly according to claim 1, wherein the filler orifice of the expansion chamber is situated after a joggle at the smaller end of the expansion chamber.

11. An assembly according to claim 1, wherein the expansion chamber and the water box are made from a single piece moulding, with the larger end of the expansion chamber being the end through which a moulding core is extracted after the moulding material has set.

12. An assembly according to claim 1, wherein the water box and the expansion chamber are disposed generally vertically with the add-on cover plate closing the bottom of the expansion chamber.

13. A heat exchanger, in particular a radiator for a motor vehicle, including the expansion chamber and water box assembly claimed in claim 1.

* * * * *